US006712487B2

(12) United States Patent
Liou

(10) Patent No.: US 6,712,487 B2
(45) Date of Patent: Mar. 30, 2004

(54) LIGHT EMITTING GOLF BALL

(75) Inventor: Hsueh-Yen Liou, Taichung (TW)

(73) Assignee: Andrew Yang, Taipei (TW)

( * ) Notice: Subject to any disclaimer, the term of this patent is extended or adjusted under 35 U.S.C. 154(b) by 0 days.

(21) Appl. No.: 10/128,273

(22) Filed: Apr. 24, 2002

(65) Prior Publication Data

US 2003/0202362 A1 Oct. 30, 2003

(51) Int. Cl.[7] ..... F21V 33/00

(52) U.S. Cl. ..... 362/253; 362/555; 362/363; 362/276; 473/570; 446/485

(58) Field of Search ..... 362/253, 555, 362/276, 545, 800, 295; 473/570; 446/485

(56) References Cited

U.S. PATENT DOCUMENTS 5,236,383 A * 8/1993 Connelly ..... 446/219
5,490,047 A * 2/1996 O'Rourke et al. ..... 473/570
6,142,894 A * 11/2000 Lee ..... 473/570
6,464,602 B1 * 10/2002 Rottger ..... 473/571

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

A light emitting golf ball is constructed to include a plastic outer shell that admits light, a plastic core embedded in the outer shell, the plastic core admitting light, and a light emitting circuit assembly embedded in the core, the light emitting circuit assembly including a battery, a plurality of LEDs, and an impact switch electrically connected between the battery and the LEDs and adapted to turn on the LEDs upon an impact.

1 Claim, 3 Drawing Sheets

LIGHT EMITTING GOLF BALL

BACKGROUND OF THE INVENTION

1. Field of the Invention

The present invention relates to golf balls and, more particularly, to a light emitting golf ball adapted for use in the night, which emits light when driven into the air.

2. Description of the Related Art

Conventional golf balls do not emit light. When playing golf in the night, the player cannot accurately estimate the direction and amount of the flying of the golf ball under limited illumination of field lamps. When the golf ball was driven into the rough, water hazard, or any dark place in the course, the player may have to spend a lot of time finding the ball.

SUMMARY OF THE INVENTION

The present invention has been accomplished under the circumstances in view. It is the main object of the present invention to provide a light emitting golf ball, which is practical for playing in the night. It is another object of the present invention to provide a light emitting golf ball, which emits light only when driven into the air by a golf club. To achieve these and other objects of the present invention and according to one aspect of the present invention, the light emitting golf ball comprises a plastic outer shell that admits light, a plastic core embedded in the outer shell, the plastic core admitting light, and a light emitting circuit assembly embedded in the core. The light emitting circuit assembly comprises a battery, a plurality of LEDs, and an impact switch electrically connected between the battery and the LEDs and adapted to turn on the LEDs upon an impact. According to another aspect of the present invention, the light emitting circuit assembly is provided with a control IC adapted to control the flash mode of the LEDs subject to the control of the impact switch.

BRIEF DESCRIPTION OF THE DRAWINGS

FIG. 2 is a sectional view of the light emitting golf ball present invention according to the present invention, showing the LEDs switched on.

FIG. 3 is a sectional view of the light emitting circuit assembly for the light emitting golf ball according to the present invention, showing the LEDs switched on.

DETAILED DESCRIPTION OF THE PREFERRED EMBODIMENT

Figure 1A:
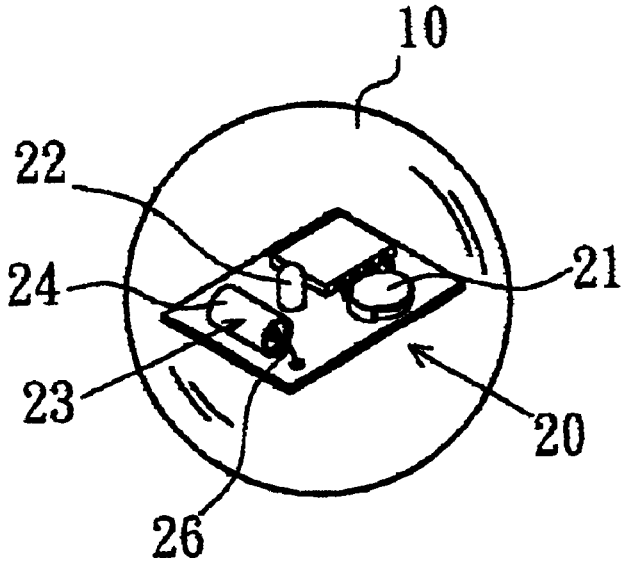
FIG. 1A illustrates a light emitting circuit assembly embedded in a spherical core according to the present invention.
Figure 1B:
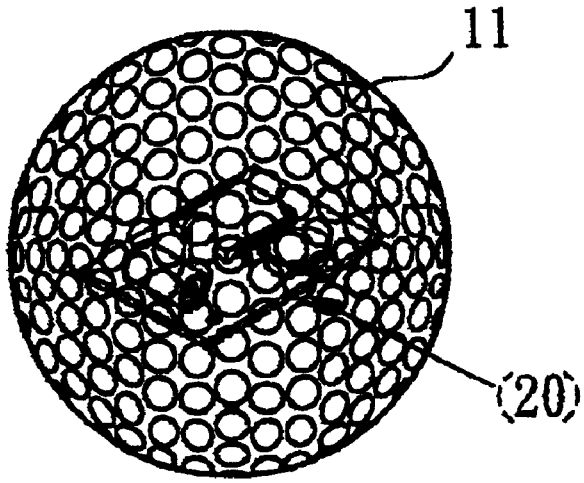
FIG. 1B is a perspective view of a light emitting golf ball according to the present invention.
Figure 2:
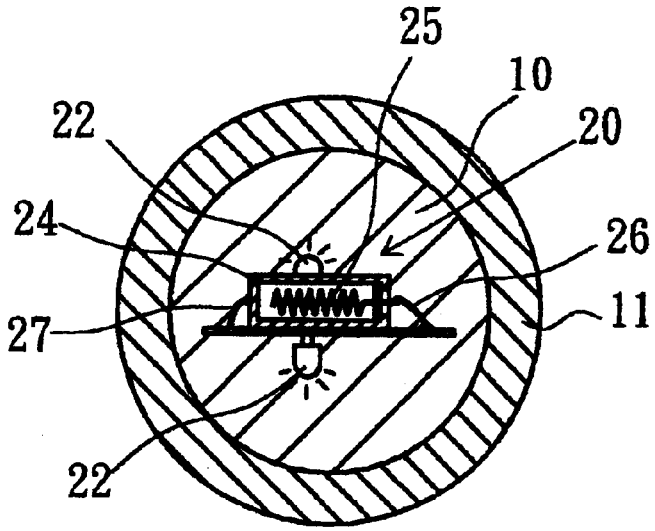
Figure 3:
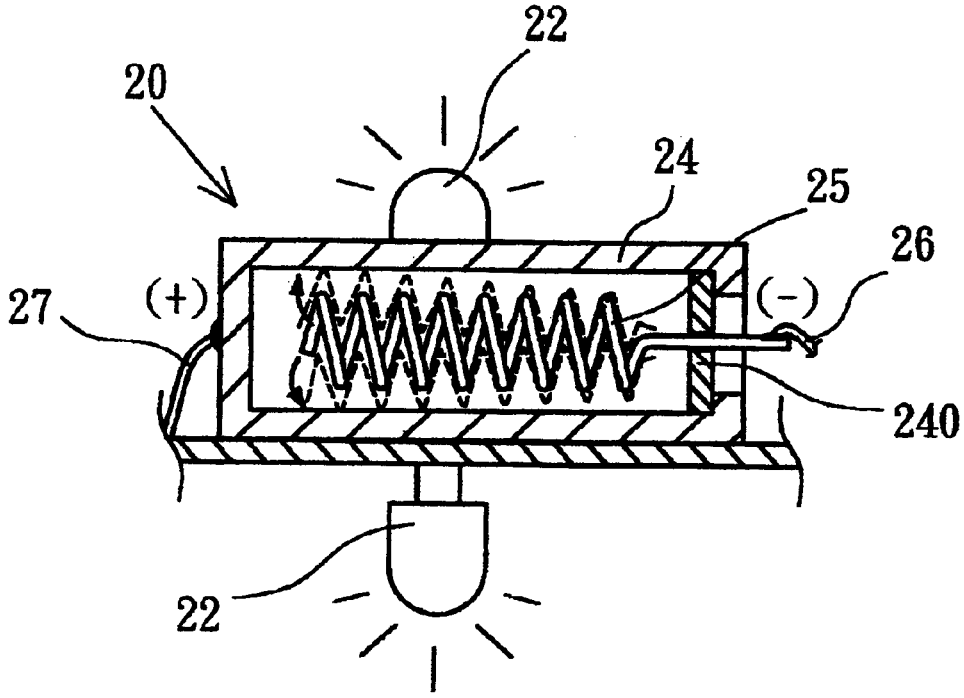
Figure 4:
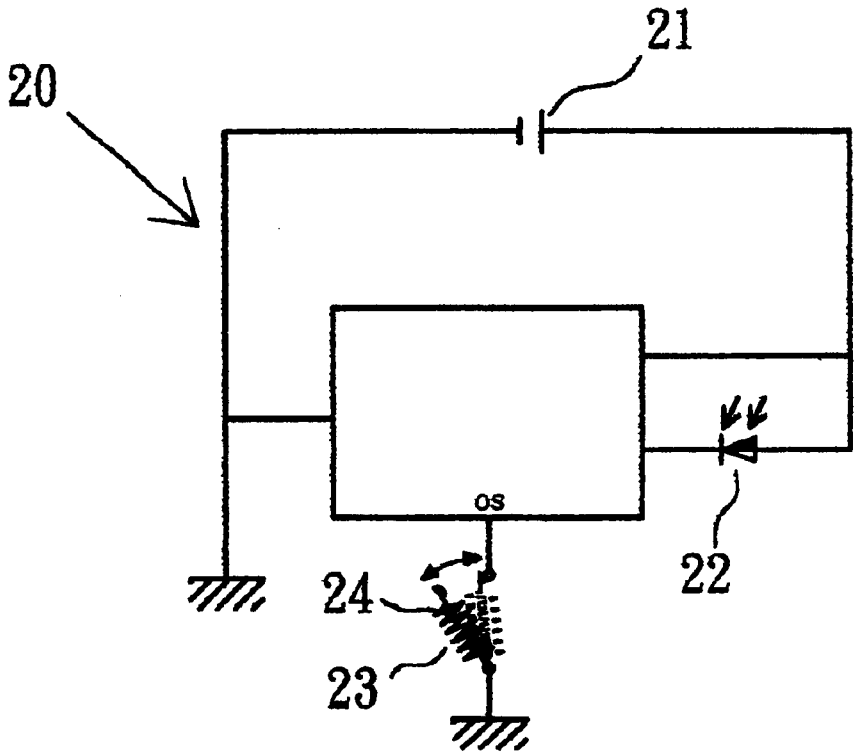
FIG. 4 is a circuit diagram of the light emitting circuit assembly according to the present invention.

Referring to FIGS. from 1 through 4, a light emitting golf ball is shown comprised of an outer shell 11 that admits light, a core 10 embedded in the outer shell 11, the core 10 admitting light, and a light emitting circuit assembly 20 embedded in the core 10. The light emitting circuit assembly 20 comprises a battery 21 that provides the necessary working voltage, a plurality of LEDs (light emitting diodes) 22, and an impact switch 23 electrically connected between the battery 21 and the LEDs 22. The impact switch 23 is comprised of a metal casing 24 and a metal spring 25. The metal casing 24 is connected to one terminal, for example, the positive terminal of the battery 21 by a conductor 27. The metal spring 25 is suspended inside the metal casing 24, having one end inserted through an electrically insulative pad 240 in the metal casing 24 and connected to the other terminal, namely, the negative terminal of the battery 21 by a conductor 26.

Referring to FIGS. from 2 through 4 again, when carrying the light emitting golf ball or holding it with the hand, the vibration force is insufficient to vibrate metal spring 25 violently. At this time, the metal spring 25 does not touch the metal casing 24, and therefore the impact switch 23 is off. When the user hits the light emitting golf ball with the club, the heavy impact forces the metal spring 25 to vibrate violently, thereby causing the metal spring 25 to contact the inside wall of the metal casing 24 intermittently. When the metal spring 25 touched the inside wall of the metal casing 24, the impact switch 24 triggers the control IC of the light emitting circuit assembly 20, causing the control IC of the light emitting circuit assembly 20 to flash the LEDs 22 subject to a predetermined flashing mode for a predetermined length of time.

When driven the light emitting golf ball into the air in the night, the light emitting golf ball flashes, like a line of light passing over the sky. Because the control IC of the light emitting circuit assembly drives the LEDs 22 to flash or to emit light for a predetermined length of time when triggered by the impact switch 24, the user can see the light emitting golf ball in the dark from a distance.

Further, the outer shell 11 and the core 10 are made of plastics that provide sufficient resilient strength and, meet standard golf specification requirements. Because the light emitting circuit assembly 20 is embedded in the core 10, it is positively positioned in the light emitting golf ball. Impact of the light emitting golf ball does not cause the light emitting circuit assembly 20 to displace.

Although a particular embodiment of the invention has been described in detail for purposes of illustration, various modifications and enhancements may be made without departing from the spirit and scope of the invention. For example, bristles may be separately installed in the periphery of the ball body and spaced from one another at an equal pitch.

What the invention claimed is:

1. A light emitting golf ball comprising a substantially solid plastic core formed of a light transmissive material, a plastic outer shell that transmits light surrounding said plastic core, and a light emitting circuit assembly embedded within said core, said light emitting circuit assembly including a battery, a control circuit coupled to said battery, a plurality of light emitting diodes coupled to said control circuit, and an impact switch electrically connected between said battery and said control circuit to turn on said light emitting diodes for a predetermined time period responsive to an impact of said golf ball by a golf club, said impact switch including a metal casing connected to a terminal of said control circuit, and a metal spring suspended in said metal casing and electrically connected to one terminal of said battery, said metal spring being adapted to vibrate sufficiently to contact said metal casing responsive to said golf ball being struck by a golf club.

* * * * *

UNITED STATES PATENT AND TRADEMARK OFFICE

CERTIFICATE OF CORRECTION

PATENT NO. : 6,712,487 B2
DATED : March 30, 2004
INVENTOR(S) : Hsueh-Yen Liou

It is certified that error appears in the above-identified patent and that said Letters Patent is hereby corrected as shown below:

Title page,
Item [73], Assignee, delete the name "Andrew Yang" and insert therefore the name -- Andrew Wang --.

Signed and Sealed this

Seventh Day of December, 2004

JON W. DUDAS
*Director of the United States Patent and Trademark Office*